US008556461B2

(12) United States Patent
Kim et al.

(10) Patent No.: US 8,556,461 B2
(45) Date of Patent: Oct. 15, 2013

(54) LIGHTING DEVICE

(75) Inventors: Kwang Soo Kim, Seoul (KR); Young Ho Shin, Seoul (KR); Ki Man Park, Seoul (KR); Bu Kwan Je, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/365,655

(22) Filed: Feb. 3, 2012

(65) Prior Publication Data

US 2012/0212930 A1 Aug. 23, 2012

(30) Foreign Application Priority Data

Feb. 23, 2011 (KR) ..... 10-2011-0015986
Feb. 23, 2011 (KR) ..... 10-2011-0015987
Mar. 4, 2011 (KR) ..... 10-2011-0019266

(51) Int. Cl.
*F21V 21/00* (2006.01)

(52) U.S. Cl.
USPC ... 362/249.01; 362/84; 362/294; 362/311.01; 362/311.02; 362/373; 362/249.02

(58) Field of Classification Search
USPC ..... 362/84, 235, 249.01–249.02, 294, 362/311.01–311.02, 373
See application file for complete search history.

(56) References Cited

U.S. PATENT DOCUMENTS

2011/0181167 A1 * 7/2011 Cho et al. ..... 313/46

* cited by examiner

*Primary Examiner* — Stephen F Husar
*Assistant Examiner* — Meghan Dunwiddie
(74) *Attorney, Agent, or Firm* — Birch, Stewart, Kolasch & Birch, LLP

(57) ABSTRACT

A lighting device may be provided that includes a light emitting module including a substrate and a light emitting device disposed on the substrate; and a case receiving the light emitting module therewithin and including an upper case disposed on the substrate and a lower case in which the substrate is disposed. The lower case includes a seating portion which is coupled to a heat sink. The seating portion is either a projection projecting outward from the outer surface of the lower case or a recess which is formed by digging inward the outer surface of the lower case.

14 Claims, 7 Drawing Sheets

LIGHTING DEVICE

CROSS-REFERENCE TO RELATED APPLICATION

The present application claims priority under 35 U.S.C. §119(e) of Korean Patent Application No. 10-2011-0015986 filed Feb. 23, 2011, No. 10-2011-0015987 filed Feb. 23, 2011 and No. 10-2011-0019266 filed Mar. 4, 2011 the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device. The lighting device includes: a light emitting module including a substrate and a light emitting device disposed on the substrate; and a case receiving the light emitting module therewithin and including an upper case disposed on the substrate and a lower case in which the substrate is disposed. The lower case includes a seating portion which is coupled to a heat sink. The seating portion is either a projection projecting outward from the outer surface of the lower case or a recess which is formed by digging inward the outer surface of the lower case.

Another embodiment is a lighting device. The lighting device includes: a lower case including one side; a light emitting module which is disposed on the one side and includes a light emitting device; a lens structure which is disposed on the one side of the lower case in such a manner as to cover the light emitting module and controls light emitted from the light emitted module; a packing structure which is disposed on the one side of the lower case in such a manner as to cover the lens structure; and an upper case which covers the packing structure and is coupled to the lower case.

Further another embodiment is a lighting device. The lighting device includes: a first case which includes a first coupler; a first light emitting module disposed in the first case; a second case which is disposed adjacent to the first case and includes a second coupler; a second light emitting module disposed in the second case; and a connection pad which connects the first case with the second case. The first coupler includes a first coupling hole, wherein the second coupler includes a second coupling hole. The connection pad includes pins which are inserted into the first coupling hole and the second coupling hole.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
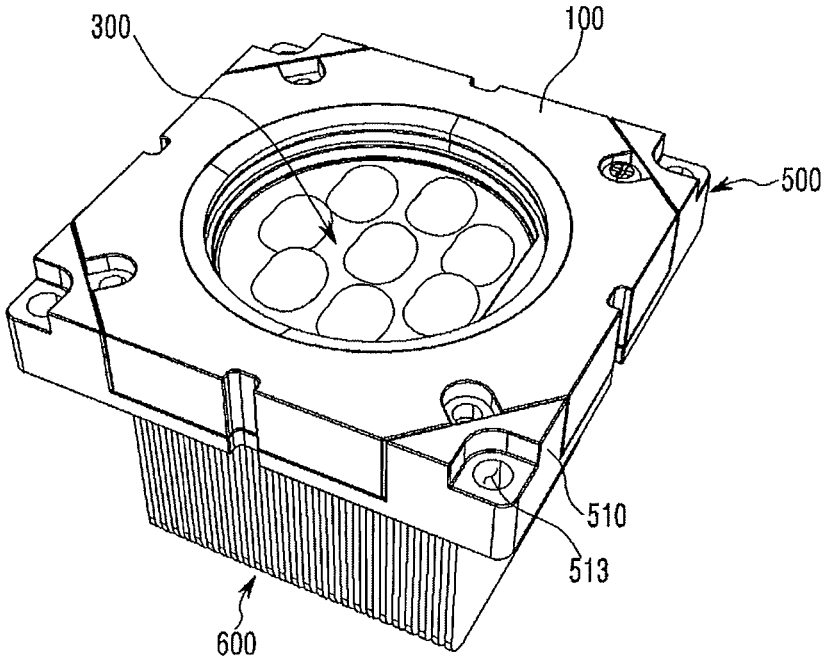
FIG. 1 is a perspective view of a lighting device according to an embodiment.
Figure 2:
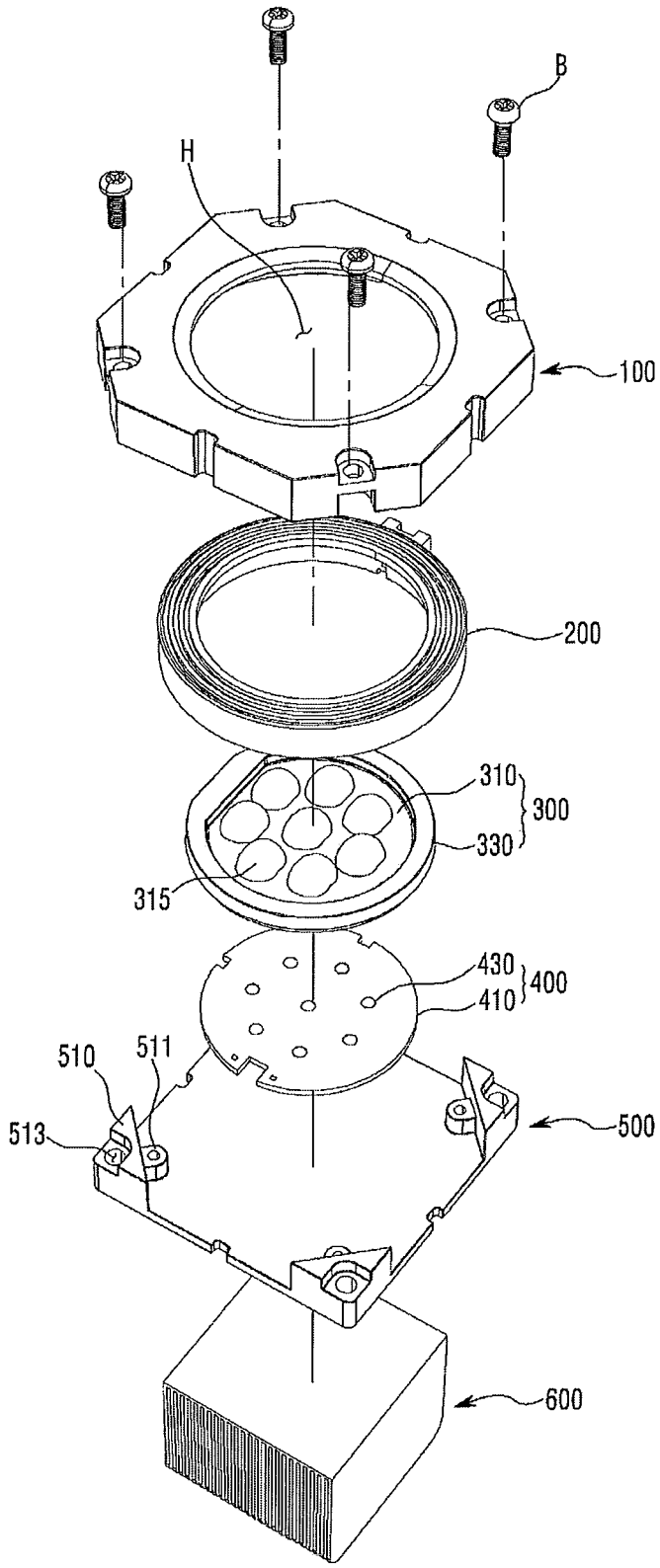
FIG. 2 is an exploded perspective view of the lighting device shown in FIG. 1.
Figure 3:
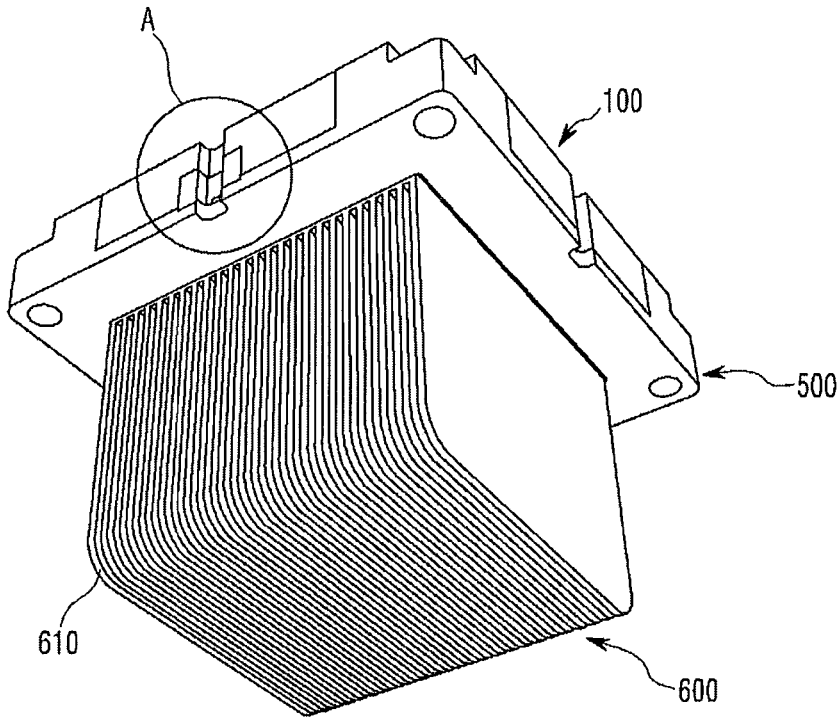
FIG. 3 is a bottom perspective view of the lighting device shown in FIG. 1.
Figure 4:
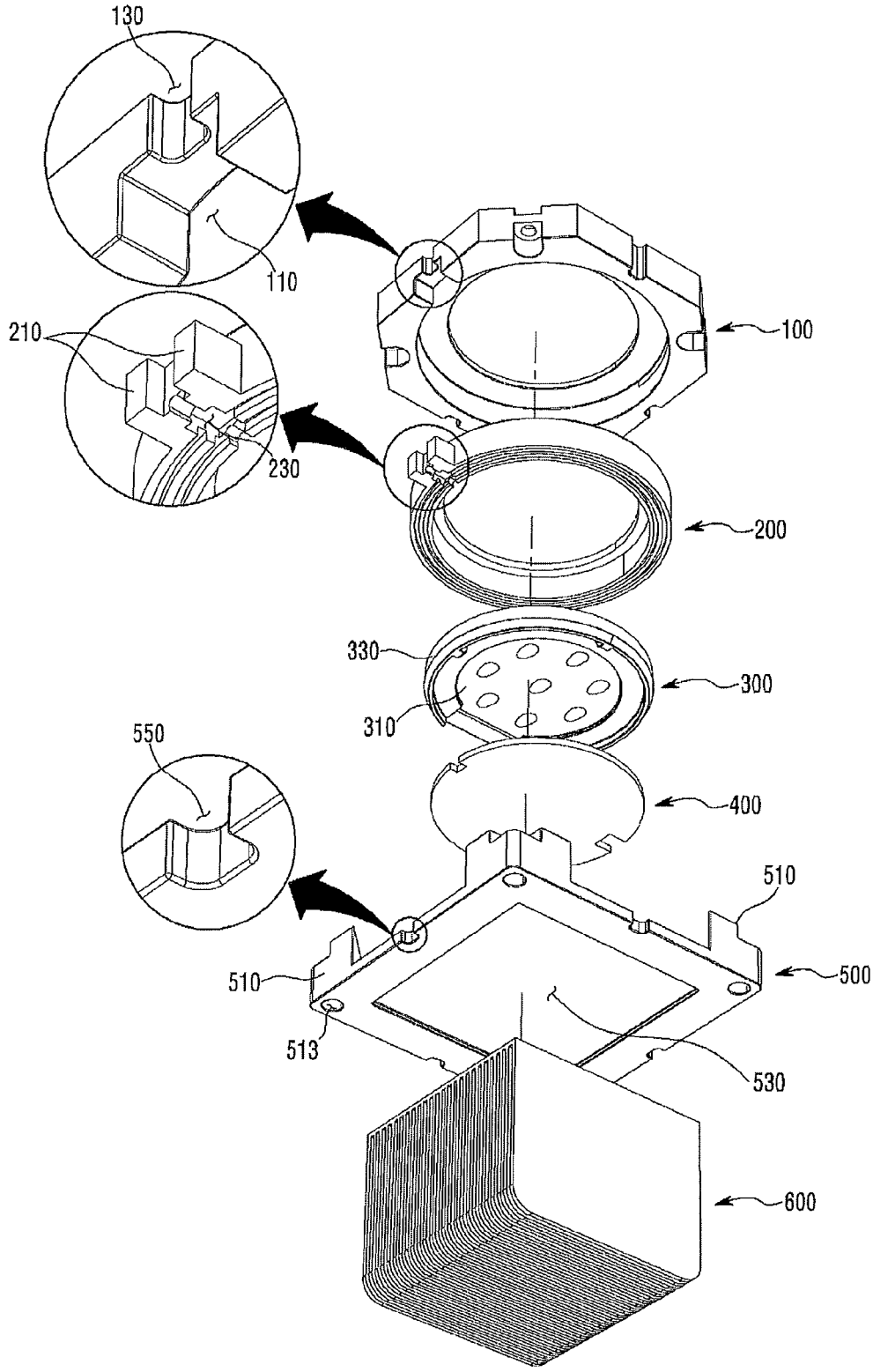
FIG. 4 is an exploded perspective view of the lighting device shown in FIG. 3.

FIG. 1 is a perspective view of a lighting device according to an embodiment. FIG. 2 is an exploded perspective view of the lighting device shown in FIG. 1. FIG. 3 is a bottom perspective view of the lighting device shown in FIG. 1. FIG. 4 is an exploded perspective view of the lighting device shown in FIG. 3.

Referring to FIGS. 1 to 4, the lighting device according to the embodiment may include an upper case 100, a packing structure 200, a lens structure 300, a light emitting module 400 and a lower case 500.

The upper case 100 is coupled to the lower case 500 and forms a body of the lighting device according to the embodiment. The upper case 100 and the lower case 500 may be strongly coupled with each other by means of a coupling means like a coupling screw "B", etc. Since the upper case 100 and the lower case 500 may be separated from each other, it is possible to easily maintain and repair the broken or damaged parts internally disposed.

A coupled body formed by the coupling of the upper case 100 and the lower case 500 may have a hexahedral shape. Here, the shape of the coupled body is not limited to be hexahedral. For example, the coupled body may have a cylindrical shape or polyhedral shape.

A predetermined receiving space may be located between the upper case 100 and the lower case 500. The packing structure 200, the lens structure 300 and the light emitting module 400 are disposed in the receiving space. Specifically, the light emitting module 400 is disposed on the lower case 500. The lens structure 300 covering the light emitting module 400 is disposed on the lower case 500. The packing structure 200 covering the lens structure 300 is disposed on the lower case 500.

The lower case 500 may be formed of a material having a heat radiating characteristic. For example, the material of the lower case 500 may include a metallic material, and specifically at least one of Al, Ni, Cu, Au or Sn. Additionally, the surface of the lower case 500 may be plated with the metallic material.

Like the lower case 500, the upper case 100 may be formed of a material having a heat radiating characteristic. However, the material of the upper case 100 is not limited to this. Specifically, the material of the upper case 100 may be a common plastic material or a synthetic resin material, each of which has no heat radiating characteristic.

The upper case 100 or the lower case 500 transfers heat generated from the light emitting module 400 to a heat sink 600 or radiates the heat itself. Here, the upper case 100 and the lower case 500 may include a plurality of fins (not shown) in order to more efficiently radiate the heat. The fins (not shown) increase the surface areas of the upper case 100 and the lower case 500, so that the heat generated from the light emitting module 400 can be effectively transferred or radiated.

The upper case 100 includes a shape of a quadrangular box and an opening "H" allowing light passing through the lens structure 300 to be emitted outward. The upper case 100 also includes holes into which the coupling screws "B" are inserted.

The lower case 500 may have a quadrangular flat plate shape. However, the shape of the lower case 500 is not limited to this. For example, the lower case 500 may have a polygonal flat plate shape.

The lower case 500 includes a coupler 510. The coupler 510 may be a protrusion projecting outward from each corner of the lower case 500.

Through the coupling of the lower case 500 and the upper case 100, the couplers 510 of the lower case 500 are placed at the corners of the upper case 100 respectively. Therefore, the coupled body formed by the coupling of the lower case 500 and the upper case 100 may have actually a hexahedral shape.

In FIGS. 1 to 4, it is shown that the coupler 510 has been formed at each corner of the lower case 500. However, there is no limit to where the coupler 510 is formed. The coupler 510 may be disposed only at some corners selected among all the corners of the lower case 500, or may be disposed on the circumference of the lower case 500 instead of the corner of the lower case 500.

The coupler 510 includes a first coupling hole 511 into which the coupling screw "B" which has passed through the upper case 100 is inserted. The upper case 100 and the lower case 500 can be securely coupled to each other by passing the coupling screw "B" through the upper case 100 and inserting the coupling screw "B" into the first coupling hole 511. The first coupling hole 511 may have a shape projecting from the coupler 510 toward the center of the lower case 500.

The coupler 510 includes a second coupling hole 513. The second coupling hole 513 is used for connecting a plurality of the lighting devices shown in FIG. 1. This will be described in detail with reference to FIG. 5.

Figure 5:
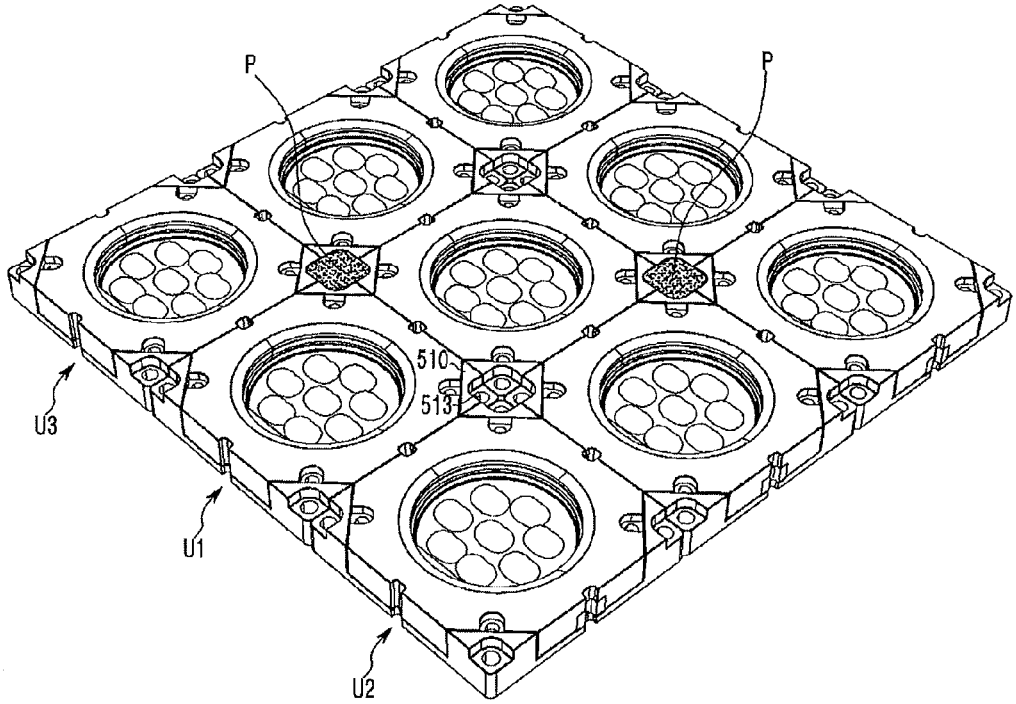
FIG. 5 is a perspective view showing that a plurality of the lighting devices shown in FIG. 1 have been connected to each other.

FIG. 5 is a perspective view showing that a plurality of the lighting devices shown in FIG. 1 have been connected to each other.

A second lighting device U2 and a third lighting device U3 are disposed adjacent to each other on the basis of a first lighting device U1.

The coupler 510 of the first lighting device U1 come in contact with the couplers of other two neighboring lighting devices. The second coupling hole 513 of the first lighting device U1, the second coupling hole of the second lighting device U2 and the second coupling holes of the other two lighting devices are disposed adjacent to each other.

A connection pad "P" is inserted into the four adjacent coupling holes 513. The four adjacent lighting devices may be coupled to each other by the connection pad "P". Therefore, the coupled four lighting devices can be used as one lighting device. The connection pad "P" will be described with reference to FIG. 6.

Figure 6:
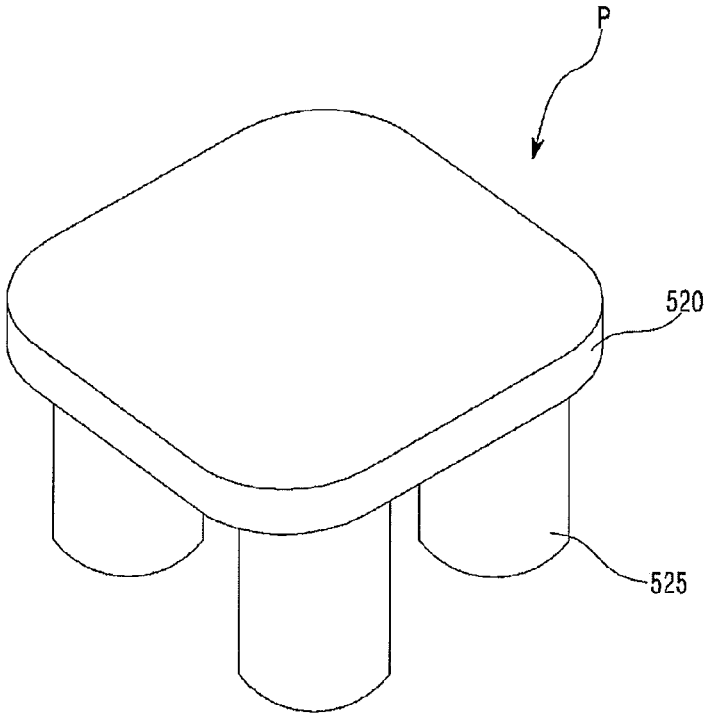
FIG. 6 is a perspective view of a connection pad shown in FIG. 5.

FIG. 6 is a perspective view of the connection pad "P" shown in FIG. 5.

Referring to FIG. 6, the connection pad "P" includes a plate 520 and four pins 525. The four pins 525 project outward from the bottom surface of the plate 520 and are inserted into the four coupling holes 513 shown in FIG. 4.

The top surface of the plate 520 may be disposed on the same plane with the outer surface of the upper case of the first lighting device U1 shown in FIG. 5.

As shown in FIGS. 1 to 6, the lighting device according to the embodiment has an advantage that it can be connected to other lighting devices which are the same as the lighting device itself. Therefore, when one lighting device shown in FIG. 1 is not able to provide desired brightness, a user has an advantage of obtaining desired brightness by connecting a plurality of the lighting devices shown in FIG. 1.

Referring back to FIGS. 1 to 4, the bottom surface of the lower case 500 includes a seating portion 530 in which the heat sink 600 is disposed.

The seating portion 530 may be a recess which is formed by digging a portion of the bottom surface of the lower case 500 to a predetermined depth. A portion of the heat sink 600 is disposed in the recess 530. Specifically, a portion of the heat sink 600 is inserted into the recess 530. Here, the seating portion 530 is not limited to the recess. This will be described with reference to FIG. 7.

Figure 7:
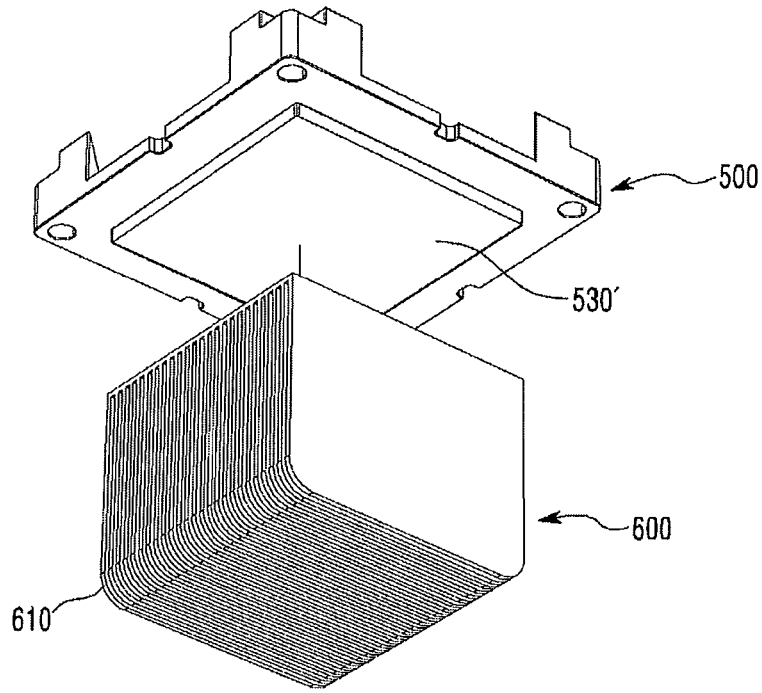
FIG. 7 is an exploded perspective view for describing a modified example of a lower case of the lighting device shown in FIG. 4.

FIG. 7 is an exploded perspective view for describing a modified example of the lower case of the lighting device shown in FIG. 4.

Referring to FIG. 7, a seating portion 530' may be a projection projecting outward from the bottom surface of the lower case 500. When the seating portion 530' is a projection, the heat sink 600 may have a recess (not shown) into which the projection 530' is inserted.

Referring back to FIGS. 1 to 4, the seating portion 530 may be disposed in the bottom surface of the lower case 500, particularly, under the light emitting module 400. Specifically, the seating portion 530 is disposed at the central portion of the bottom surface of the lower case 500. The light emitting module 400 is disposed at the central portion of the top surface of the lower case 500. Since the light emitting module 400 generates the largest amount of heat, the seating portion 530 is disposed just under the light emitting module 400 in the bottom surface of the lower case 500.

The heat sink 600 is coupled to the seating portion 530 of the lower case 500. Here, the heat sink 600 may be coupled to the seating portion 530 of the lower case 500 without a separate coupling means. Specifically, the heat sink 600 may be coupled to the lower case 500 by inserting a portion of the upper portion of the heat sink 600 into the recess 530 of the lower case 500. Additionally, the heat sink 600 may be easily separated from the lower case 500. In the lighting device according to the embodiment, the recess 530 of the lower case 500 allows the heat sink 600 to be easily attached or removed without a separate coupling means.

The lighting device according to the embodiment does not necessarily require the heat sink 600 which occupies the most weight and thickness of a conventional lighting device. Therefore, the lighting device according to the embodiment can be smaller and lighter. Also, it is possible to reduce the cost of the heat sink 600 in the total manufacturing cost of the lighting device.

Further, the lighting device according to the embodiment is able to semi-permanently use the one heat sink 600.

The heat sink 600 may have a plurality of heat radiating fins 610. The plurality of the heat radiating fins 610 increase the surface area of the heat sink 600 and improve a heat radiation efficiency.

The light emitting module 400 is disposed in the lower case 500 and may include a substrate 410 and a plurality of light emitting devices 430 disposed on the substrate 410.

The substrate 410 may have, as shown in the drawings, a disc shape. However, the shape of the substrate 410 is not limited to this. The substrate 410 may be formed by printing a circuit on an insulator and may include an aluminum substrate, a ceramic substrate, a metal core PCB or a common PCB.

The substrate 410 is disposed on the top surface of the lower case 500.

The plurality of the light emitting devices 430 are arranged on one side of the substrate 410. The one side of the substrate 410 may have a color capable of efficiently reflecting light, for example, white color. The other side of the substrate 410 comes in contact with the top surface of the lower case 500.

Figure 8:
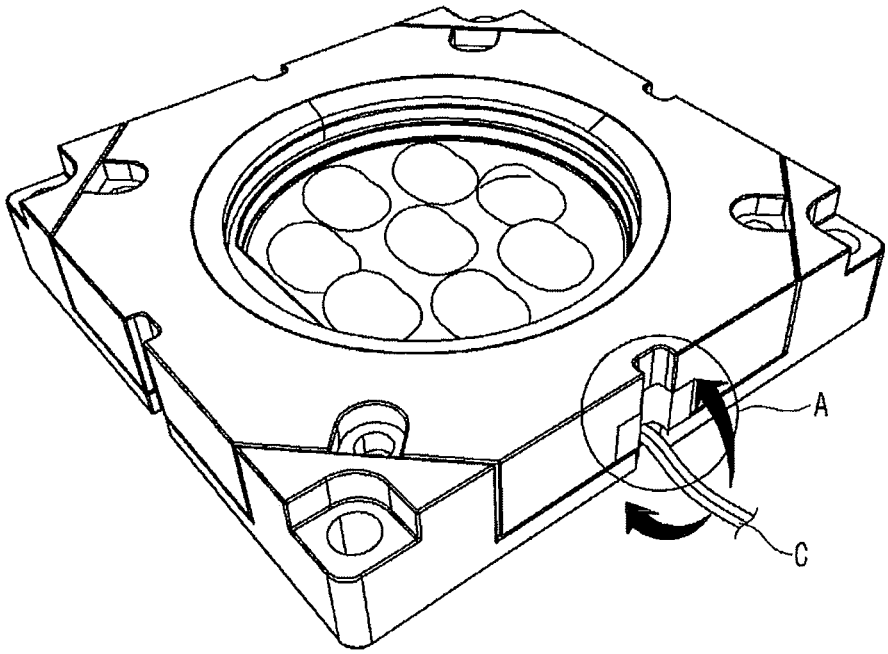
FIG. 8 is a perspective view for describing the flexibility of a cable connected to the lighting device shown in FIG. 1.

The substrate 410 is electrically connected to a cable "C" shown in FIG. 8. The substrate 410 is supplied with an electric power through the cable "C".

The substrate 410 may include a DC converter or a protective device. The DC converter converts AC to DC and supplies the DC. The protective device protects the lighting device from ESD, a Surge phenomenon or the like.

A heat radiating plate (not shown) may be disposed on the bottom surface of the substrate 410. The heat radiating plate (not shown) may efficiently transfer the heat generated from the light emitting module 400 to the lower case 500. The heat radiating plate (not shown) may be formed of a material having thermal conductivity. For example, the heat radiating plate may be a thermal conduction silicon pad or a thermal conductive tape.

The plurality of the light emitting devices 430 are disposed on the substrate 410. Here, the plurality of the light emitting devices 430 may be disposed on the substrate 410 in the form of an array. The shapes and the number of the plurality of the light emitting devices 430 may be variously changed according to needs.

The light emitting device 430 may be a light emitting diode (LED). At least one of a red LED, a blue LED, a green LED or a white LED may be selectively used as the light emitting device 430.

The lens structure 300 may include a lens unit 310 and an outer frame 330. The lens structure 330 receives the light emitting module 400. Specifically, the cylindrical outer frame 330 surrounds the side of the substrate 410, and the lens unit 310 is disposed on one side of the substrate 410. As a result, the light emitting module 400 is received in the lens structure 300.

The lens unit 310 includes at least one dorm-shaped lens 315. Here, the dorm-shaped lens 315 may be changed in various forms if necessary, for example, a hemispherical shape, a concave shape, a convex shape or the like.

When the lens 315 of the lens unit 310 has a hemispherical shape, although not specially shown in the drawings, the bottom surface of the lens 315, that is to say, a light incident surface may have an irregular shape or a prism shape in order to improve efficiency and obtain a desired light distribution.

The lens 315 controls light emitted from the light emitting module 400. Here, the control of the light means diffusion or collection of the light from the light emitting module 400. Specifically, when the light emitting device 430 of the light emitting module 400 is a light emitting diode, the lens 315 is able to diffuse the light from the light emitting device 430. Additionally, the lens 315 is also able to collect the light from the light emitting device 430 instead of diffusing.

The lens 315 may one-to-one correspond to the light emitting device 430 of the light emitting module 400. That is, the number of the lenses 315 corresponds to the number of the light emitting devices 430. For example, as shown in FIG. 2, when 8 light emitting devices 430 are disposed on the substrate 410, 8 lenses 315 one-to-one correspond to the 8 light emitting devices 430. Here, the lens 315 may one-to-many correspond to the light emitting device 430 of the light emitting module 400. In other words, one lens 315 may correspond to two or more light emitting devices 430.

The lens 315 may include a fluorescent material (not shown). The fluorescent material may be a yellow fluorescent material, a green fluorescent material or a red fluorescent material. When the light emitting device 430 of the light emitting module 400 is a blue light emitting diode, the lens 315 may include at least one of the yellow, green and red fluorescent materials. Due to the fluorescent material included in the lens 315, a color rendering index (CRI) of light emitted from the lighting device according to the embodiment can be improved.

The outer frame 330 is disposed on the top surface of the lower case 500 in such a manner as to cover the light emitting module 400.

The outer frame 330 is disposed on the top surface of the lower case 500, so that the lens unit 310 is spaced apart from the light emitting device 430 of the light emitting module 400 at a certain interval. Therefore, the outer frame 330 forms a predetermined space between the lens unit 310 and the light emitting device 430. When the light emitting device 430 of the light emitting module 400 is a light emitting diode, a beam angle of light emitted from the light emitting device 430 is approximately 120°. In order to obtain a designer's desired light distribution by using the beam angle, a certain interval "G1" is required between the light emitting device 430 and the lens unit 310.

The outer frame 330 is received in the packing structure 200. Specifically, the outer frame 330 is surrounded by the packing structure 200. Therefore, the packing structure 200 protects the outer frame 330 from external impact.

The lens structure 300 may be injection-molded by using a light-transmitting material. The material of the lens structure 300 may be implemented by glass or a plastic material such as poly methyl methacrylate (PMMA) or polycarbonate (PC) or the like.

The packing structure 200 is disposed on the lower case 500 and receives the lens structure 300. Specifically, the packing structure 200 is disposed on the top surface of the lower case 500 in such a manner as to cover the lens structure 300.

The packing structure 200 is disposed between the upper case 100 and the lower case 500, which prevents water and impurity from penetrating into the lens structure 300 and the light emitting module 400. The packing structure 200 is able to protect the lens structure 300 and the light emitting module 400 from external impact.

The packing structure 200 may have a circular ring shape to surround the outer frame 330 of the lens structure 300.

The packing structure 200 may be formed of a material which easily absorbs shock without allowing water to penetrate thereinto. For example, the packing structure 200 may be formed of a waterproof rubber, a waterproof silicon material or the like. Here, when the packing structure 200 is formed of an elastic material such as the rubber or the silicon material, the packing structure 200 is pressed between the upper case 100 and the lower case 500.

The lighting device according to the embodiment shown in FIGS. 1 to 4 is able to improve the flexibility of a cable supplying electric power to the lighting device. Hereafter, this will be described with reference to FIG. 8.

FIG. 8 is a perspective view for describing the flexibility of the cable connected to the lighting device shown in FIG. 1.

Referring to FIGS. 3 and 8, a part "A" is equipped with an electric wire "C" supplying electric power to the lighting device according to the embodiment. The electric wire "C" is electrically connected to the light emitting module 400 shown in FIG. 2 and supplies electric power to the light emitting module 400. Here, the electric wire "C" may be a general cable "C". Hereafter, the electric wire "C" will be described by assuming that the electric wire "C" is a cable "C".

The cable "C" can freely move to the upper case 100 or the lower case 500. A structure for improving the flexibility of the cable "C" will be described in detail with reference to FIG. 4.

Referring to FIG. 4, the upper case 100 includes an insertion recess 110 and an upper seating recess 130. The packing structure 200 includes a projection 210 and a cover recess 230. The lower case 500 includes a lower seating recess 550.

In the coupling of the packing structure 200 and the upper case 100, the insertion recess 110 of the upper case 100 receives the projection 210 of the packing structure 200.

The cable "C" is seated in the upper seating recess 130 of the upper case 100. When the cable "C" is expected to be disposed toward the upper case 100, the upper seating recess 130 receives the cable "C".

The projection 210 of the packing structure 200 has a shape projecting outward from one side of the packing structure 200. The projection 210 is received in the insertion recess 110 of the upper case 100. Here, a portion of the projection 210 is exposed outward.

The projection 210 includes the cover recess 230. A portion of the cable "C" is disposed in the cover recess 230. The cover recess 230 protects the cable "C" and prevents the movement of the cable "C" in the lighting device.

The cable "C" disposed in the cover recess 230 is pressed between the packing structure 200 and the top surface of the lower case 500. Therefore, water or impurity which is introduced along the surface of the cable "C" is blocked.

The cable "C" is seated in the lower seating recess 550 of the lower case 500. When the cable "C" is expected to be disposed toward the lower case 500, the lower seating recess 550 receives the cable "C".

The insertion recess 110 and the upper seating recess 130 of the upper case 100, the projection 210 and the cover recess 230 of the packing structure 200, and the lower seating recess 550 of the lower case 500 allow the cable "C" electrically connected to the light emitting module 400 to freely move to the upper case 100 or the lower case 500 and to be disposed in the upper case 100 or the lower case 500. Therefore, the lighting device according to the embodiment has an advantage of improving the flexibility of the cable "C". Also, as shown in FIG. 5, the plurality of the lighting devices according to the embodiment can be connected with each other regardless of the disposition of the cable "C".

Figure 9:
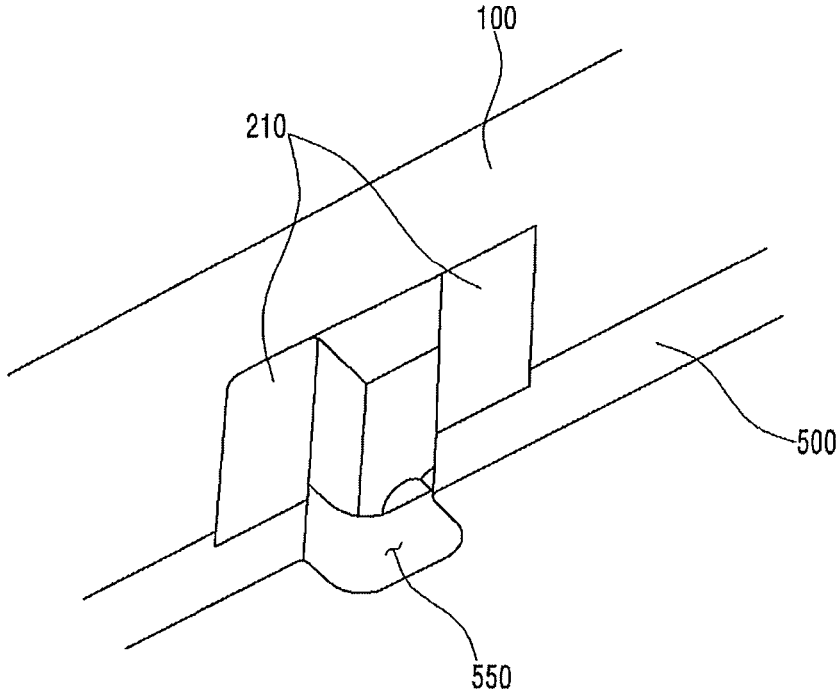
FIG. 9 shows a modified example of a part "A" shown in FIG. 3.

FIG. 9 shows a modified example of a part "A" shown in FIG. 3.

A modified example shown in FIG. 9 shows that the upper case 100 does not include the upper seating recess 130 shown in FIG. 4. In this case, the cable "C" is disposed in the lower seating recess 550 of the lower case 500.

Unlike the modified example shown in FIG. 9, the lower case 500 may not include the lower seating recess 550, and the upper case 100 may include the upper seating recess 130 shown in FIG. 4. In this case, the cable "C" is disposed in the upper seating recess 130 of the upper case 100.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light emitting module which includes a substrate and a light emitting device disposed on the substrate; and a case which receives the light emitting module therewithin and includes an upper case disposed on the substrate and a lower case in which the substrate is disposed, wherein the lower case includes a seating portion which is coupled to a heat sink, and wherein the seating portion is either a projection projecting outward from the outer surface of the lower case or a recess which is formed by digging inward the outer surface of the lower case.

2. The lighting device of claim 1, wherein the seating portion is disposed under the light emitting module.

3. The lighting device of claim 1, further comprising a lens structure which is disposed on the lower case and receives the light emitting module; and a packing structure which is disposed on the lower case and receives the lens structure, wherein the lens structure comprises an outer frame which surrounds the substrate of the light emitting module and comprises a lens unit which is disposed on the substrate and includes lenses corresponding to the light emitting devices.

4. The lighting device of claim 3, wherein the outer frame of the lens unit causes the lens and the light emitting device to be spaced from each other at a predetermined interval.

5. The lighting device of claim 3, wherein the lens comprises at least one of yellow, green and/or red fluorescent materials.

6. The lighting device of claim 3, wherein further comprising a cable which is electrically connected to the substrate of the light emitting module, wherein the packing structure comprises a cover recess in which the cable is disposed and a projection which includes the cover recess and projects outward, wherein the upper case comprises an insertion recess into which the projection of the packing structure is inserted, and wherein the lower case comprises a lower seating recess into which the cable is inserted.

7. The lighting device of claim 6, wherein the upper case comprises an upper seating recess into which the cable is inserted.

8. The lighting device of claim 6, wherein the lower case as well as the packing structure presses the cable.

9. A lighting device comprising:

a lower case which includes one side;

a light emitting module which is disposed on the one side and includes a light emitting device;

a lens structure which is disposed on the one side of the lower case in such a manner as to cover the light emitting module and controls light emitted from the light emitted module;

a packing structure which is disposed on the one side of the lower case in such a manner as to cover the lens structure; and an upper case which covers the packing structure and is coupled to the lower case.

10. The lighting device of claim 9, wherein the lower case comprises another side corresponding to the one side, wherein the another side of the lower case comprises a seating portion which is coupled to a heat sink, and wherein the seating portion is either a projection projecting outward from the outer surface of the lower case or a recess which is formed by digging inward the outer surface of the lower case.

11. A lighting device comprising:

a first case which includes a first coupler;

a first light emitting module disposed in the first case;

a second case which is disposed adjacent to the first case and includes a second coupler;

a second light emitting module disposed in the second case; and a connection pad which connects the first case with the second case, wherein the first coupler includes a first coupling hole, wherein the second coupler includes a second coupling hole, and wherein the connection pad includes pins which are inserted into both the first coupling hole and the second coupling hole.

12. The lighting device of claim 11, wherein the first case comprises a first lower case including the first coupler and comprises a first upper case which is coupled to the first lower case, wherein the first lower case is a plate including at least one corner, and wherein the first coupler is disposed at the corner of the plate.

13. The lighting device of claim 12, further comprising:

a first lens structure which receives the first light emitting module, is disposed on the first lower case and controls light emitted from the light emitting module; and a first packing structure which receives the first lens structure and is disposed between and pressed by the first lower case and the first upper case.

14. The lighting device of claim 11, wherein each of the first and the second cases comprises a seating portion which is coupled to a heat sink, and wherein the seating portion is either a projection projecting outward from the outer surfaces of the first and the second cases or a recess which is formed by digging inward the outer surfaces of the first and the second cases.

* * * * *